US010998654B2

(12) United States Patent
Miyamura et al.

(10) Patent No.: US 10,998,654 B2
(45) Date of Patent: May 4, 2021

(54) BOARD CONNECTOR AND CONNECTION STRUCTURE FOR CIRCUIT BOARD AND BOARD CONNECTOR

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Tetsuya Miyamura, Mie (JP); Yasuo Omori, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/628,690

(22) PCT Filed: Jun. 18, 2018

(86) PCT No.: PCT/JP2018/023071
§ 371 (c)(1),
(2) Date: Jan. 6, 2020

(87) PCT Pub. No.: WO2019/009051
PCT Pub. Date: Jan. 10, 2019

(65) Prior Publication Data

US 2020/0185843 A1 Jun. 11, 2020

(30) Foreign Application Priority Data

Jul. 7, 2017 (JP) ..... JP2017-133487

(51) Int. Cl.
*H01R 12/58* (2011.01)
*H01R 12/57* (2011.01)
*H01R 12/72* (2011.01)

(52) U.S. Cl.
CPC ..... *H01R 12/58* (2013.01); *H01R 12/57* (2013.01); *H01R 12/724* (2013.01)

(58) Field of Classification Search
CPC .. H01R 12/724; H01R 13/6594; H01R 24/60; H01R 12/707; H01R 13/5216;
(Continued)

(56) References Cited

U.S. PATENT DOCUMENTS 4,915,655 A 4/1990 Tanaka
6,863,545 B2 * 3/2005 Peloza ..... H01R 12/7005 439/701

(Continued)

FOREIGN PATENT DOCUMENTS

JP 1-159370 11/1989
JP 2000-252004 9/2000

(Continued)

OTHER PUBLICATIONS

International Search Report dated Sep. 11, 2018.

*Primary Examiner* — Edwin A. Leon
*Assistant Examiner* — Matthew T Dzierzynski
(74) *Attorney, Agent, or Firm* — Gerald E. Hespos; Michael J. Porco; Matthew T. Hespos

(57) ABSTRACT

A board connector (20) has a connector housing (21) including a terminal holding portion (22) to be fixed to an upper surface (10S) of a circuit board (10) and a receptacle (23) extending forward only from an upper part (22U) and both left and right side parts (22S) of an outer periphery of the terminal holding portion (22). Male terminal fittings (30) are held through the terminal holding portion (22). Each male terminal fitting includes a board connecting portion (33) to be connected to the circuit board (10) behind the terminal holding portion (22) and a tab-like connecting portion (31) accommodated in the receptacle (23). The receptacle (23)
(Continued)

does not include a lower wall to be overlapped on the upper surface (10S) of the circuit board (10). Thus, a height of the board connector can be reduced by a thickness of the lower wall.

11 Claims, 8 Drawing Sheets

(58) Field of Classification Search
CPC ..... H01R 13/6585; H01R 2107/00; H01R 43/24; H01R 12/716; H01R 13/405; H01R 13/516; H01R 13/6272; H01R 13/639; H01R 13/6581; H01R 24/62; H01R 43/005; H01R 12/51; H01R 12/7011; H01R 12/712; H01R 12/721
See application file for complete search history.

(56) References Cited

U.S. PATENT DOCUMENTS 7,182,610 B2 * 2/2007 Lin ..... H01R 12/707 439/567
7,435,110 B2 * 10/2008 Xiao ..... H01R 12/58 439/107
7,883,369 B1 * 2/2011 Sun ..... H01R 12/721 439/607.35
7,963,787 B2 * 6/2011 Demonica ..... H01R 13/50 439/326
8,123,532 B2 * 2/2012 Davison ..... H01R 13/518 439/79
8,262,414 B1 * 9/2012 Li ..... H01R 13/6273 439/607.35
8,272,897 B1 * 9/2012 Lin ..... H01R 12/724 439/607.4
8,348,688 B2 * 1/2013 Liu ..... H01R 13/5219 439/271
8,662,928 B1 * 3/2014 Xie ..... H01R 13/6594 439/607.58
8,974,244 B2 * 3/2015 Aihara ..... H01R 12/724 439/374
9,112,299 B2 * 8/2015 Lu ..... H01R 43/005
9,178,319 B2 * 11/2015 Little ..... H01R 13/6585
9,774,130 B2 * 9/2017 Zhao ..... H01R 12/716
9,837,734 B2 * 12/2017 Wang ..... H01R 24/60
2003/0171014 A1 9/2003 Lin
2010/0112836 A1 * 5/2010 Aihara ..... H01R 12/7011 439/79
2014/0357098 A1 * 12/2014 Yu ..... H01R 13/11 439/59
2016/0141792 A1 5/2016 Zhao et al.

FOREIGN PATENT DOCUMENTS

JP 2000-348801 12/2000
JP 2004-039626 2/2004
JP 2012-151046 8/2012
JP 2016-096133 5/2016

* cited by examiner

BOARD CONNECTOR AND CONNECTION STRUCTURE FOR CIRCUIT BOARD AND BOARD CONNECTOR

BACKGROUND

Field of the Invention

The invention relates to a board connector and a connection structure for circuit board and board connector.

Related Art

Japanese Unexamined Patent Publication No. 2012-151046 discloses a board connector to be mounted on a circuit board. This board connector includes a housing to be fixed on the circuit board, and terminal fittings mounted in the housing. The housing includes a terminal holding portion for holding the terminal fittings penetrating therethrough and a receptacle extending forward from the outer periphery of the terminal holding portion.

The receptacle of the above-described board connector is in the form of a rectangular tube continuous over the entire periphery, and a lower wall of the receptacle is placed to overlap the upper surface of the circuit board. Thus, there has been a problem that a height from the surface of the circuit board to an upper wall of the receptacle is large.

The invention was completed on the basis of the above situation and aims to reduce a height.

SUMMARY

A first aspect of the invention includes a connector housing having a terminal holding portion to be fixed to an upper surface of a circuit board. A receptacle extends forward only from an upper part and both left and right sides of an outer periphery of the terminal holding portion. Male terminal fittings are held through the terminal holding portion. Each male terminal fitting has a board connecting portion to be connected to the circuit board behind the terminal holding portion and a tab-like connecting portion accommodated in the receptacle.

A second aspect of the invention includes a circuit board, a connector housing having a terminal holding portion fixed to an upper surface of the circuit board and a receptacle extending forward from only an upper part and both left and right sides of an outer periphery of the terminal holding portion. Male terminal fittings are held through the terminal holding portion. Each male terminal fitting has a board connecting portion connected to the circuit board behind the terminal holding portion and a tab-like connecting portion accommodated in the receptacle.

According to the first and second aspects of the invention, the receptacle does not include a lower wall to be overlapped on the upper surface of the circuit board. Thus, a height of the board connector can be reduced by a thickness of the lower wall.

A coupling may link lower areas of the left and right walls of the receptacle in front of the terminal holding portion. According to this configuration, the strength of the receptacle can be enhanced and improper deformation of the left and right walls in a lateral direction can be prevented.

The coupling may be disposed in a front part of the receptacle. According to this configuration, a lower part of a female connector comes into contact with the coupling when the female connector starts being fit into the receptacle. Thus, the female connector can be positioned vertically when starting the fitting of the female connector.

The coupling may be disposed in an area in front of a front edge of the circuit board. According to this configuration, the circuit board need not be formed with a cutout for avoiding interference with the coupling.

The coupling may be disposed to contact with or proximately face the front edge of the circuit board. According to this configuration, the connector housing can be positioned in a front-rear direction when being fixed to the circuit board by bringing the coupling into contact with the front edge of the circuit board.

DETAILED DESCRIPTION

First Embodiment

Figure 1:
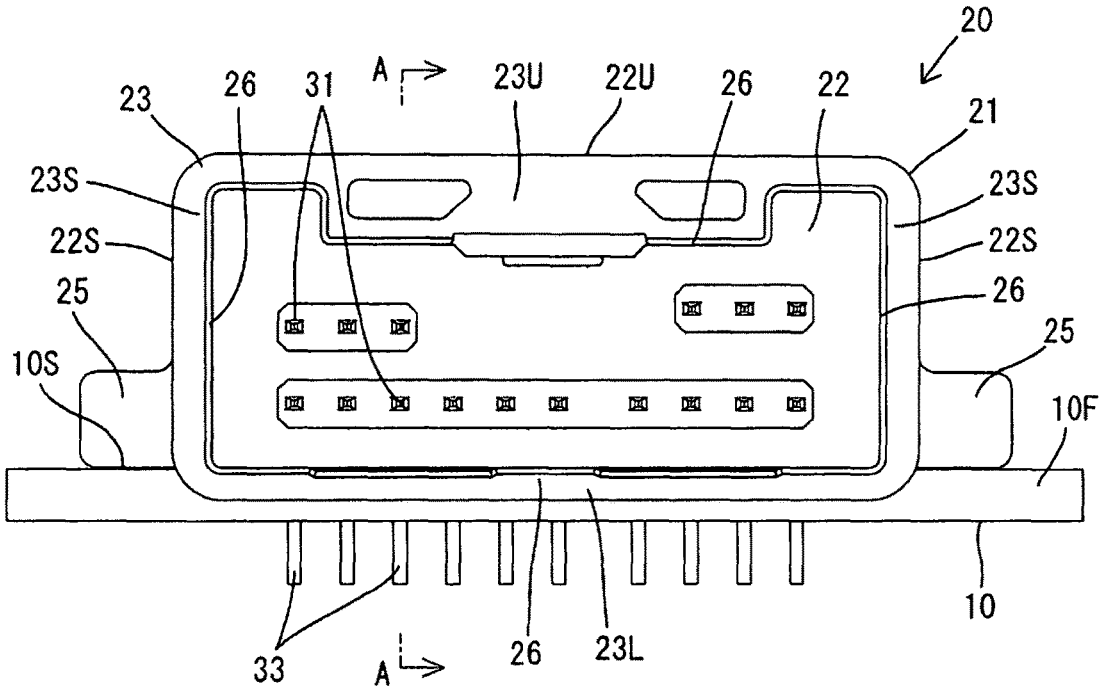
FIG. 1 is a front view showing a state where a board connector of a first embodiment is mounted on a circuit board.
Figure 2:
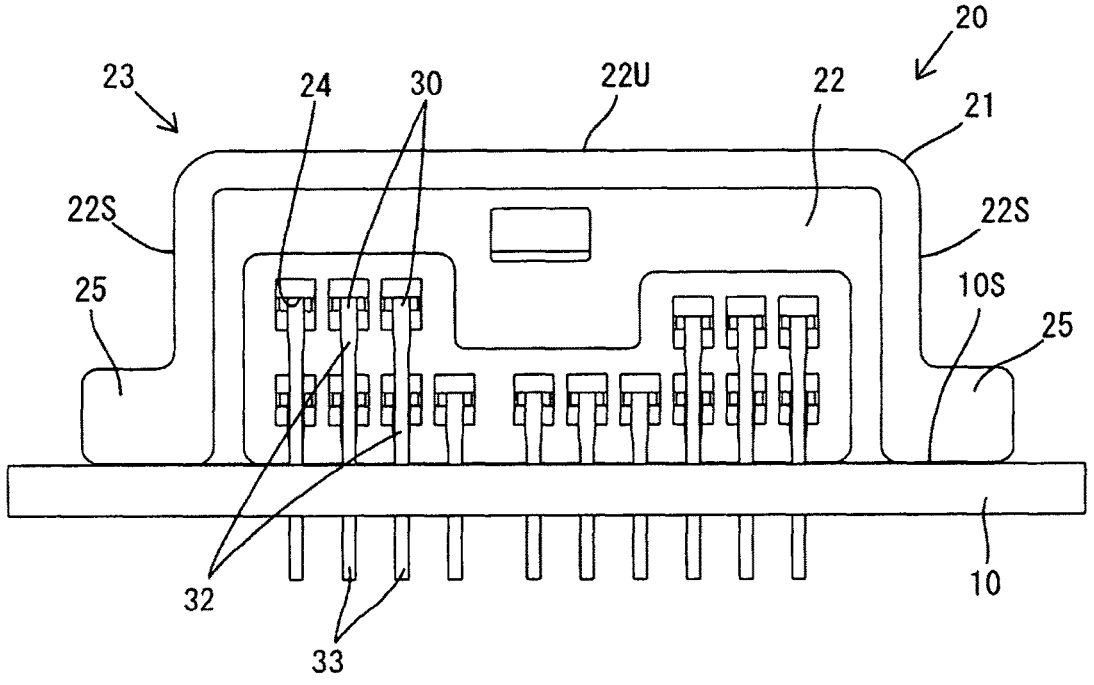
FIG. 2 is a back view showing the state where the board connector is mounted on the circuit board.
Figure 3:
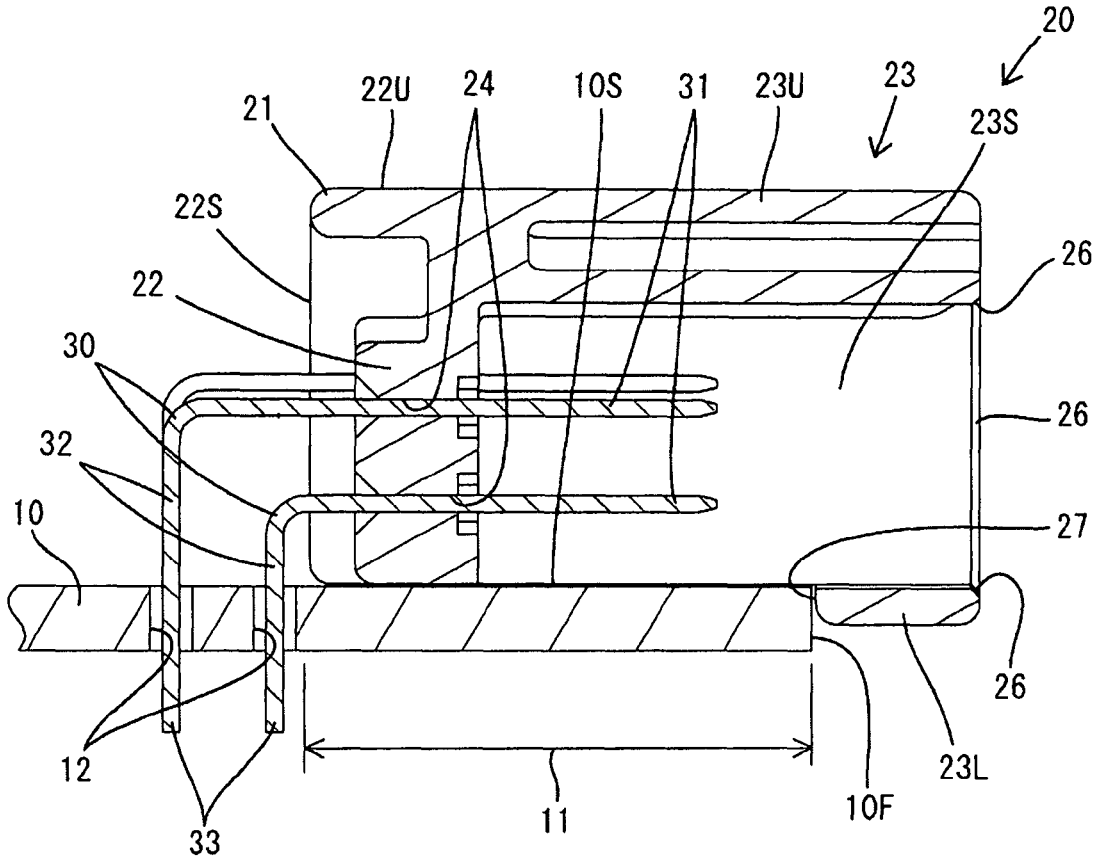
FIG. 3 is a section along A-A of FIG. 1.
Figure 4:
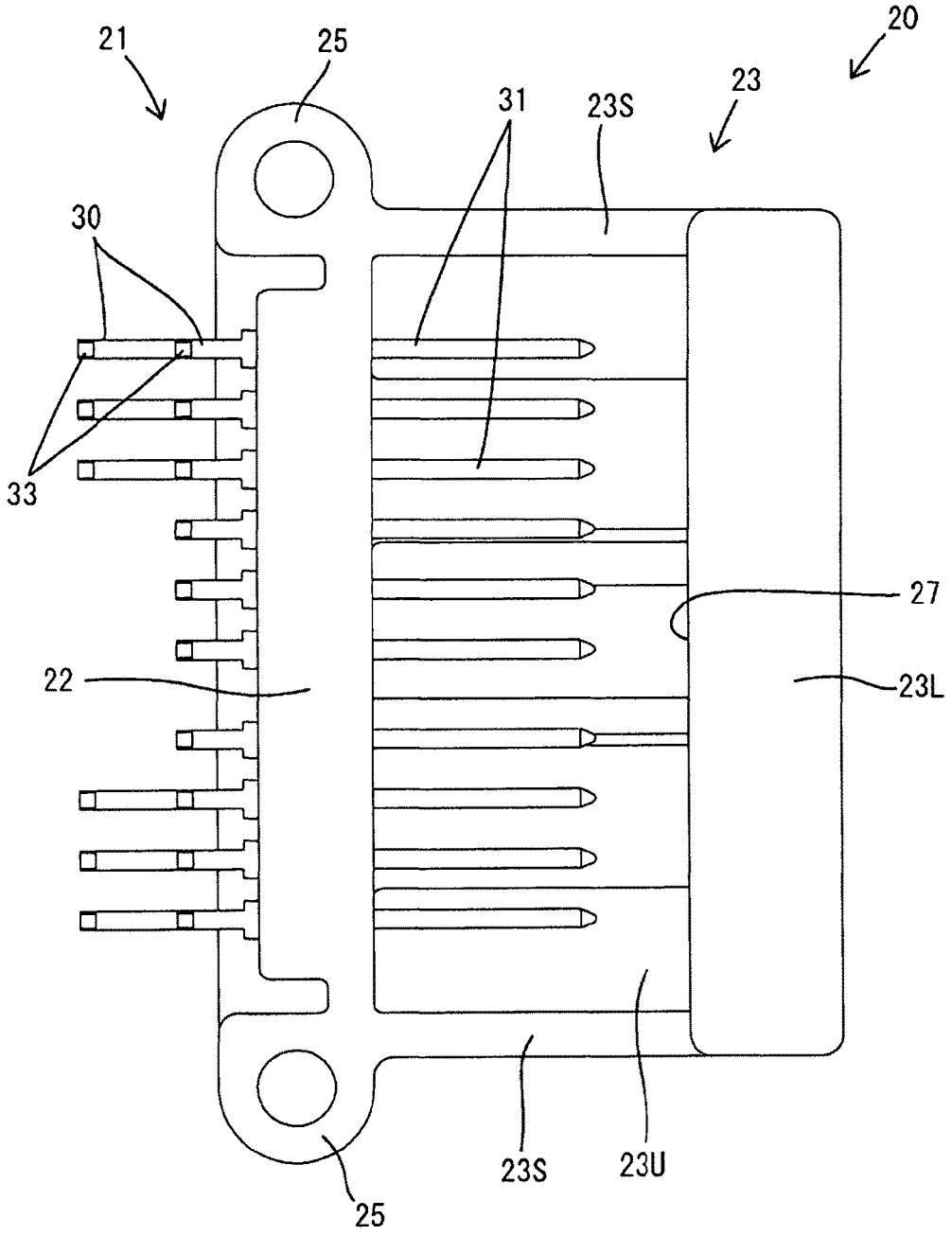
FIG. 4 is a bottom view of the board connector.
Figure 5:
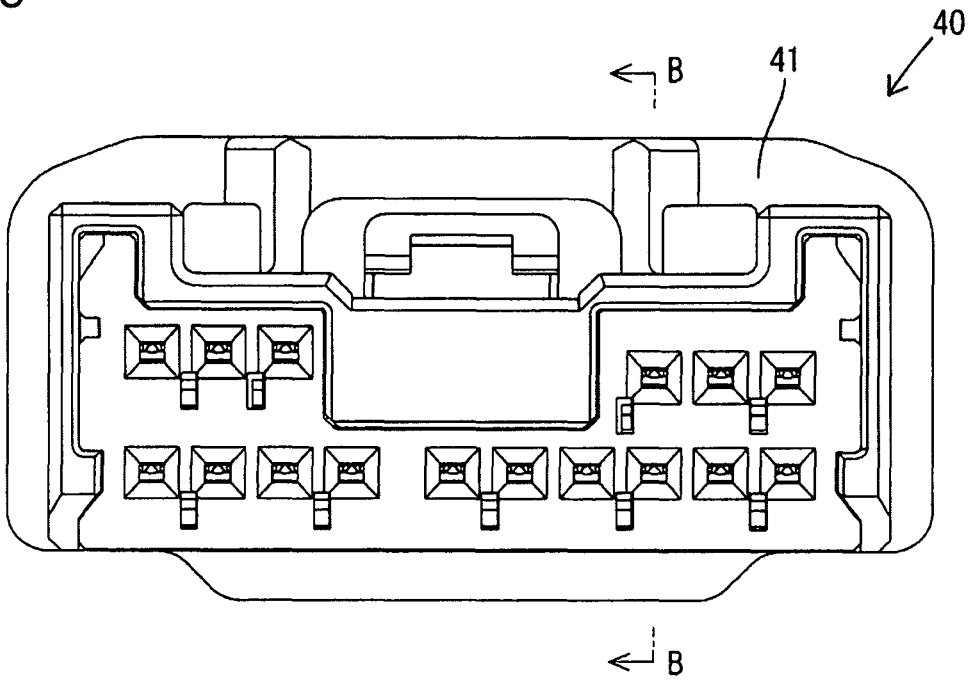
FIG. 5 is a front view of a female connector.
Figure 6:
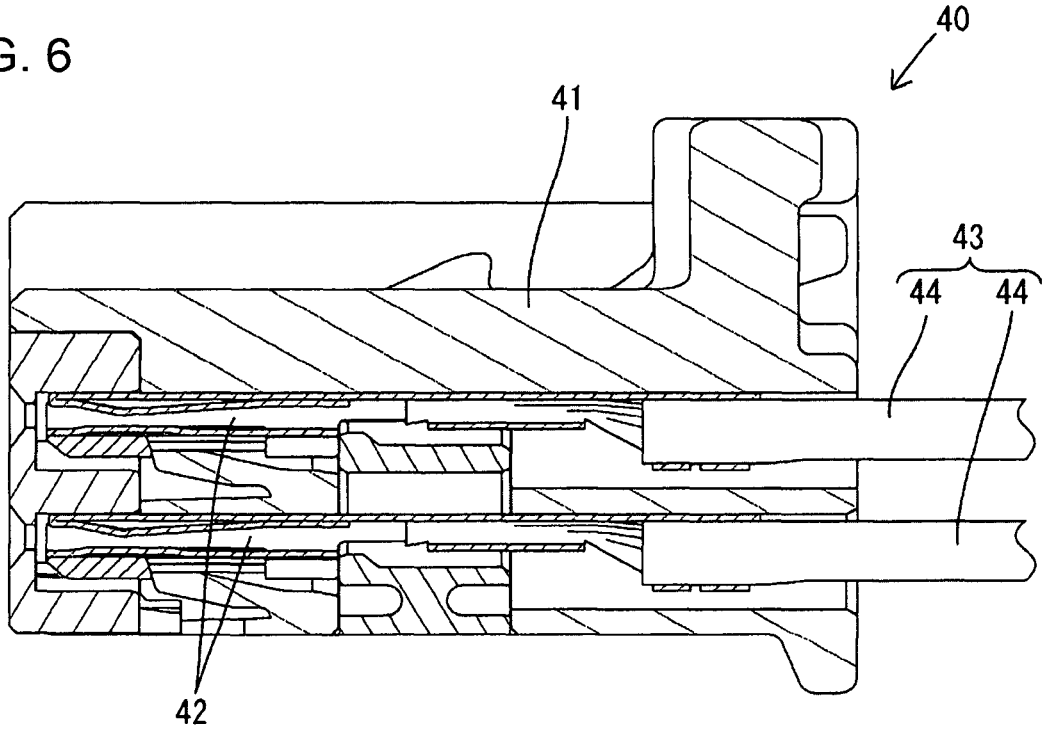
FIG. 6 is a section along B-B of FIG. 5.
Figure 7:
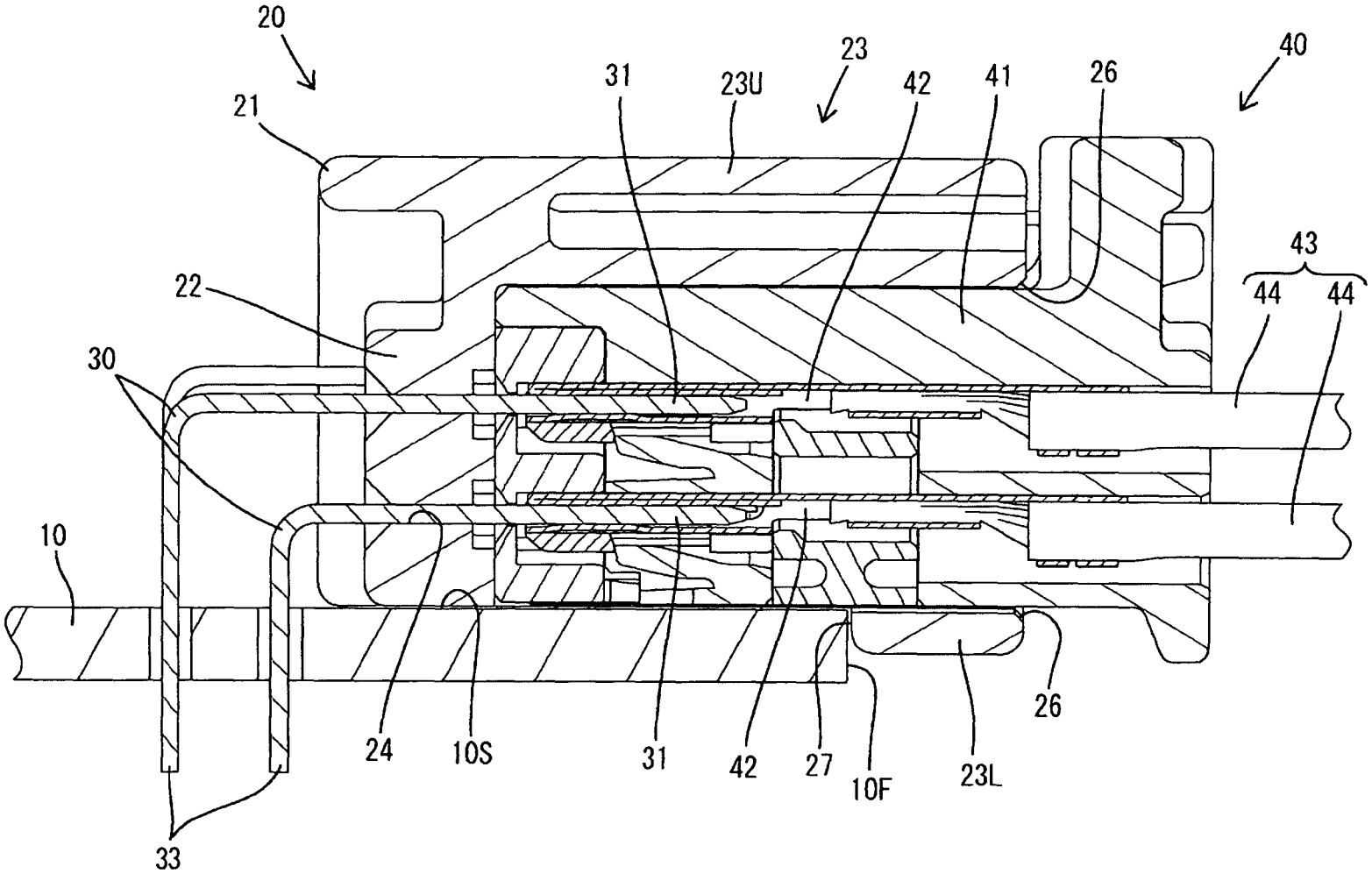
FIG. 7 is a side view in section showing a state where the board connector and the female connector are connected.
Figure 8:
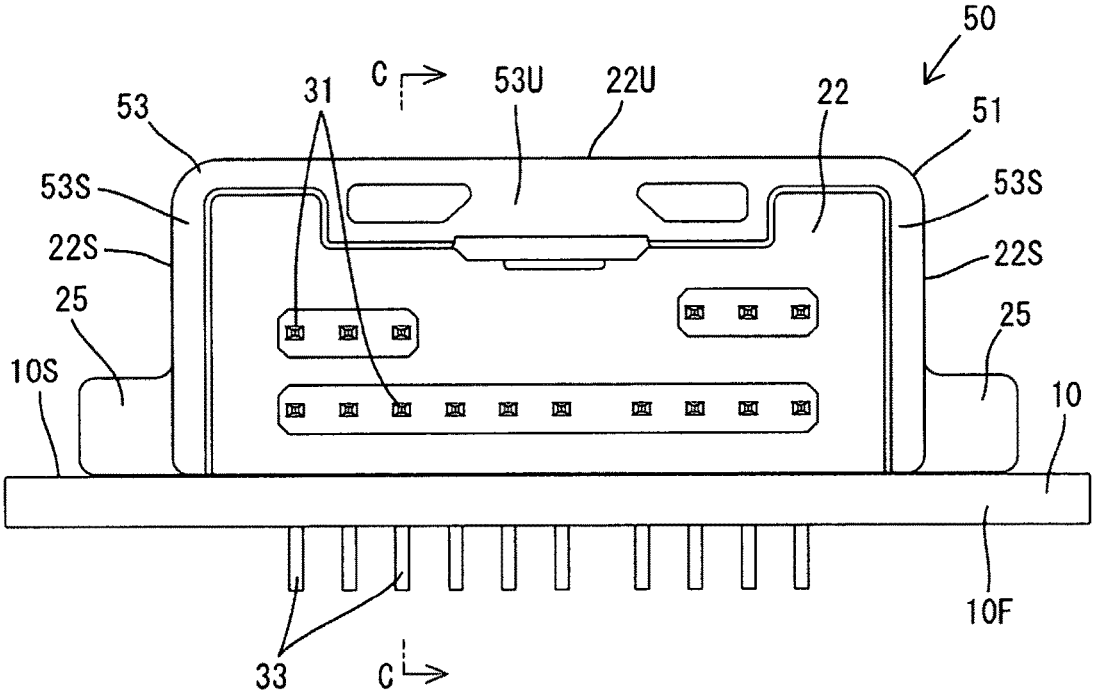
FIG. 8 is a front view showing a state where a board connector of a second embodiment is mounted on a circuit board.
Figure 9:
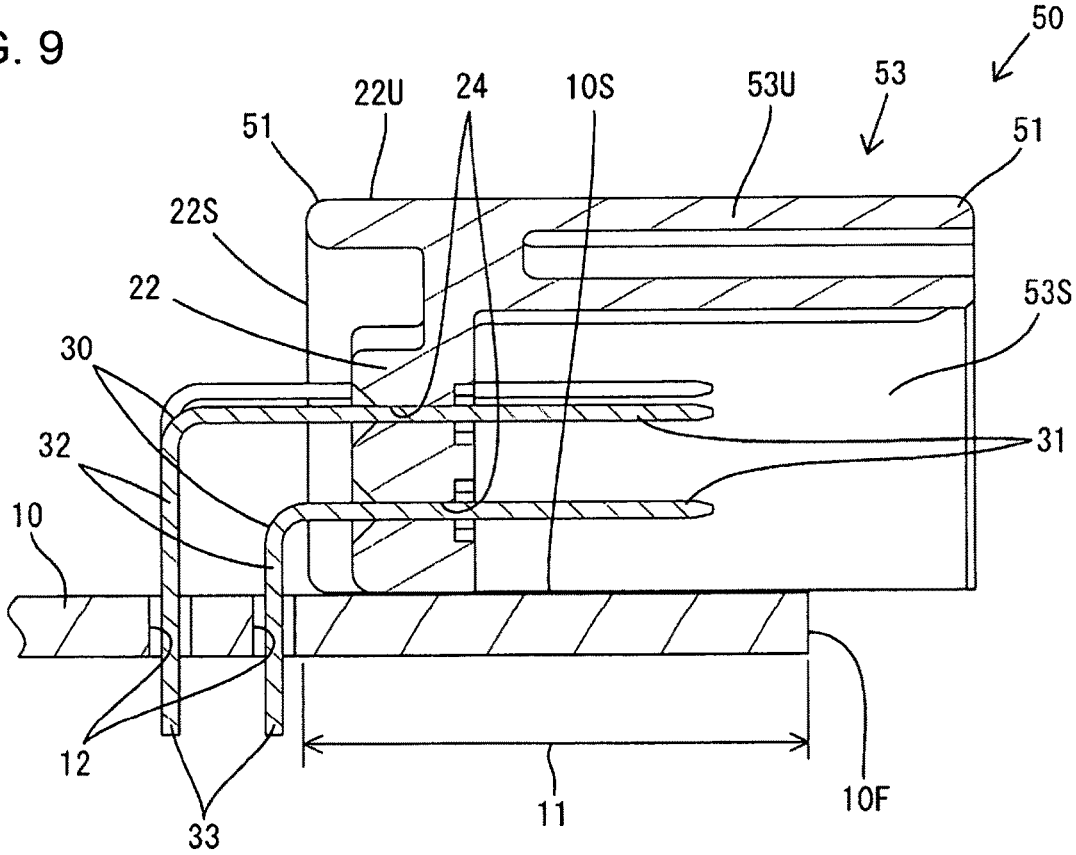
FIG. 9 is a section along C-C of FIG. 8.
Figure 10:
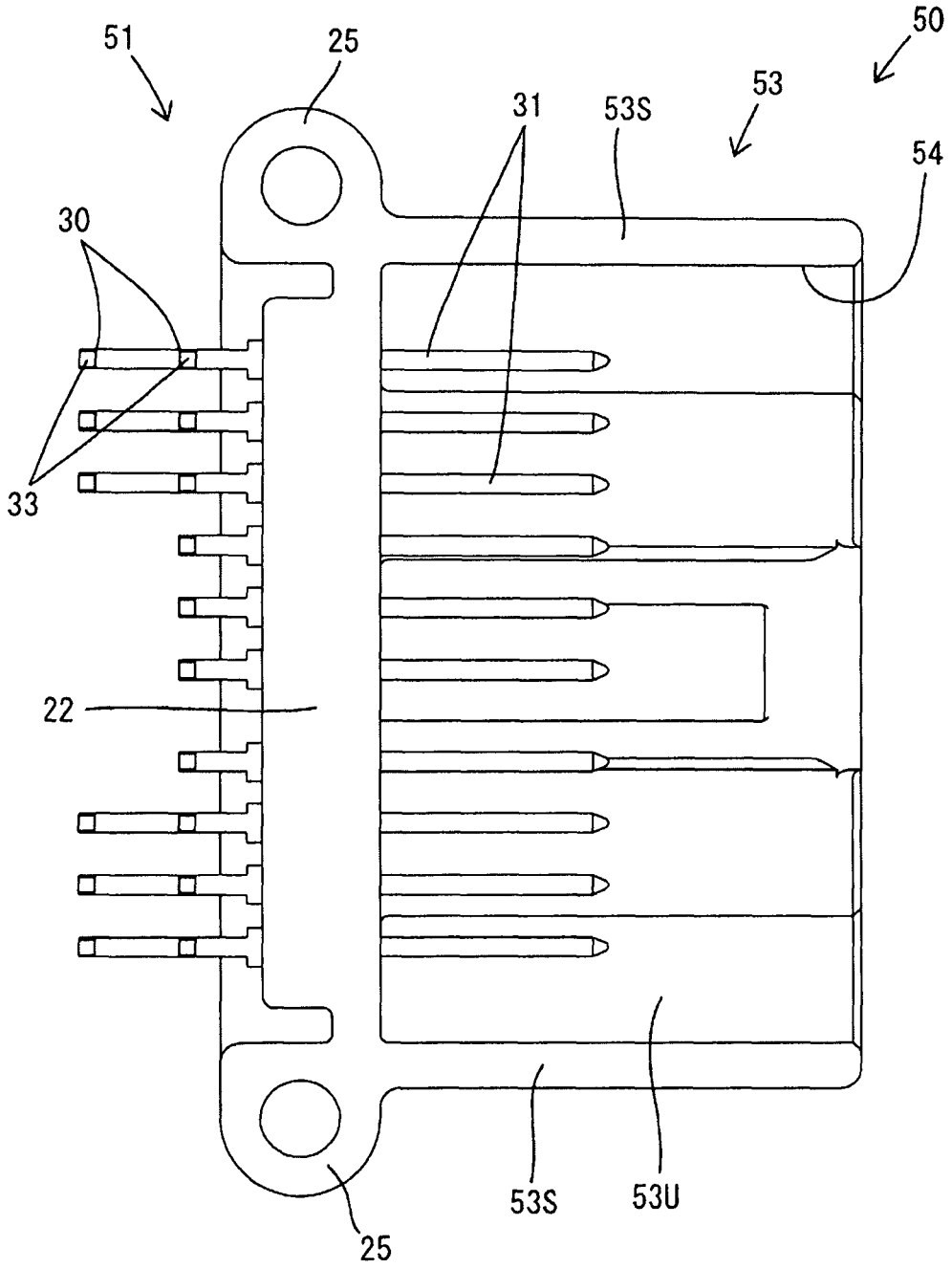
FIG. 10 is a bottom view of the board connector.
Figure 11:
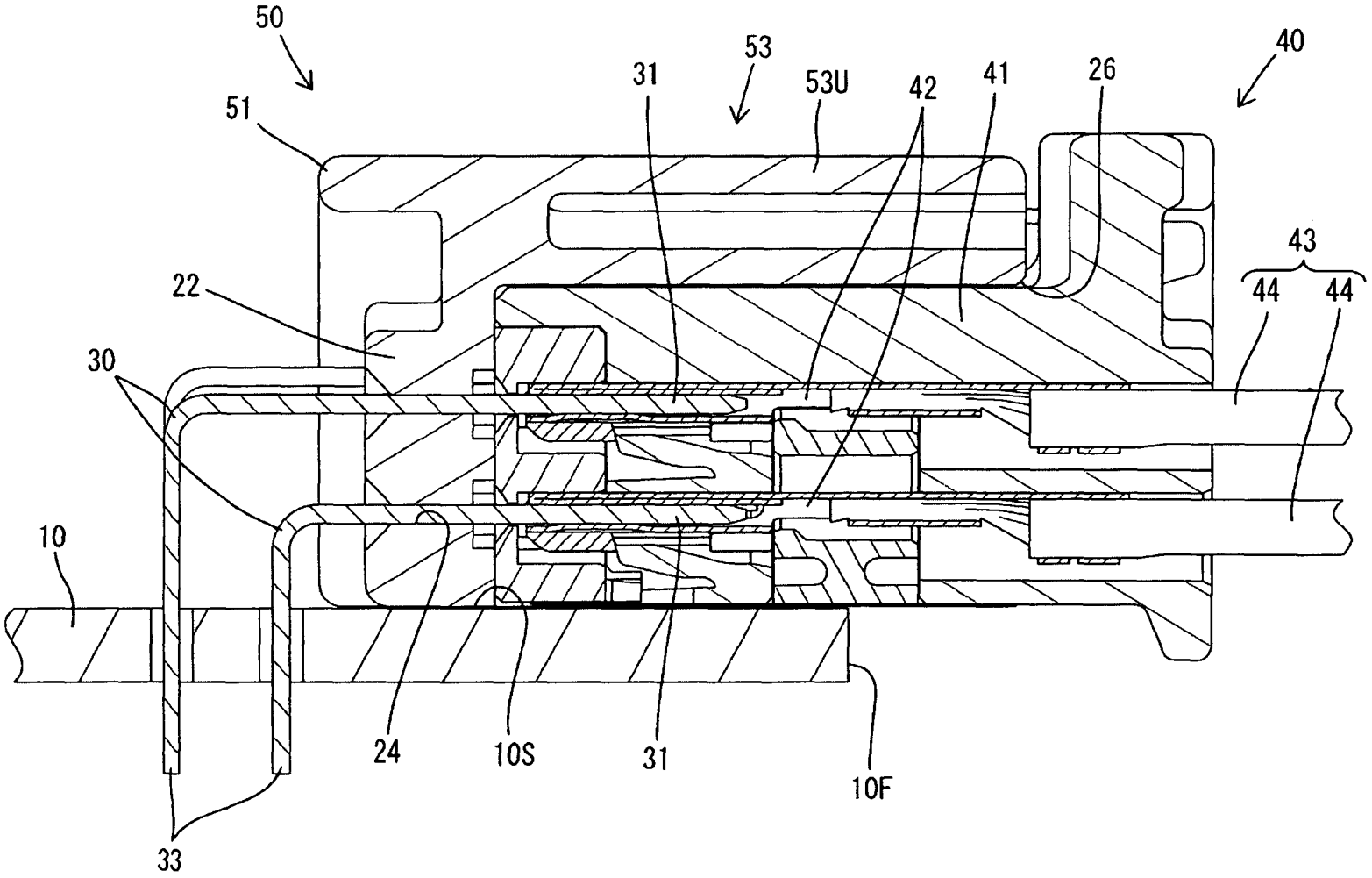
FIG. 11 is a side view in section showing a state where the board connector and a female connector are connected.

A first embodiment of the invention is described with reference to FIGS. 1 to 7. Note that, in the following description, a right side in FIGS. 3, 4 and 7 is defined as a front concerning a front-rear direction. Upper and lower sides shown in FIGS. 1 to 3 and 5 to 7 are defined as upper and lower sides concerning a vertical direction.

A board connector 20 and a connection structure for a circuit board 10 and the board connector 20 of the first embodiment are used for an Ethernet (registered trademark) high-speed communication circuit of 100 Mbps to 1 Gbps, and are mounted on a front part of an upper surface 10S of the horizontally disposed circuit board 10. A female connector 40 mounted on an end part of a wiring harness 43 is connected to the board connector 20.

The circuit board 10 is disposed horizontally while being accommodated in a casing (not shown). As shown in FIG. 3, an area of the upper surface 10S of the circuit board 10 near a front edge 10F defines a fixing area 11 at which the board connector 20 is mounted. A conductor pattern (not shown) is formed by printing in an area of the upper surface 10S of the circuit board 10 behind the fixing area 11, and through holes 12 penetrate through the circuit board 10 in the vertical direction (plate thickness direction) in an area of the conductor pattern adjacent to the fixing area 11. The front edge 10F of the circuit board 10 extends straight in a lateral direction over the entire width thereof and has no deformed part such as a recess or a projection.

The board connector 20 includes a connector housing 21 made of synthetic resin and male terminal fittings 30. The connector housing 21 is a single component including a wall-like terminal holding portion 22 substantially at a right angle to the upper surface 10S of the circuit board 10 and a receptacle 23 cantilevered forward from the terminal holding portion 22. Press-fit holes 24 penetrate the terminal holding portion 22 in the front-rear direction. Left and right mounting projections 25 are formed on lower end parts of both left and right outer side surfaces of the terminal holding portion 22.

The receptacle 23 includes a horizontal upper wall portion 23U extending forward from an upper part 22U of the substantially rectangular outer periphery of the terminal holding portion 22, left and right side walls 23S in the form of flat plates extending forward from both left and right sides 22S of the outer periphery of the terminal holding portion 22, and a coupling 23L. The receptacle 23 is cantilevered forward only from the upper part 22U and both left and right side parts 22S of the outer y of the terminal holding portion 22, and is not connected directly to a lower part of the outer periphery of the terminal holding portion 22

Both left and right sides of the upper wall 23U and upper ends of both left and right side walls 23S are connected substantially at a right angle in a front view. A formation area of the upper wall 23U and those of both left and right side walls 23S are in the same range in the front-rear direction. The lower surfaces of the left and right side walls 23S and the lower surface of the terminal holding portion 22 are at the same height in the vertical direction. A guiding surface 26 is formed on a front end of the lower surface of the upper wall 23U and is inclined up toward the front. Guiding surfaces 26 are formed also on front ends of the inner surfaces of the left and right side walls 23S and are inclined to the left and right to increase a spacing therebetween toward the front.

The coupling 23L is a flat plate long in the lateral direction and substantially parallel to the upper wall 23U. The coupling 23L couples front parts of lower edges of the left and right side walls 23S. Both left and right edges of the coupling 23L are connected substantially at a right angle to the lower end edges of the left and right side walls 23S. An opening on the front end of the receptacle 23 is formed into a window having an opening edge continuous over the entire periphery by the upper wall 23U, the left and right side walls 23S and the coupling 23L. Thus, lower side areas of the both left and right side walls 23S are not deformed to widen or narrow in a front part of the receptacle 23.

A formation range of the coupling 23L in the front-rear direction is only an area from the front end of the receptacle 23 to a position forward of a center of the receptacle 23 in the front-rear direction. An area from the front of the terminal holding portion 22 to the rear end of the coupling 23L defines a bottom surface opening 27 allowing an internal space of the receptacle 23 to communicate with a lower space outside the board connector 20. The bottom surface opening 27 is a substantially rectangular opening extending over the entire width of the receptacle 23.

The upper surface of the coupling 23L is at substantially the same vertical position as the lower surface of the terminal holding portion 22 and the lower surfaces of the left and right side walls 23S. The lower surface of the coupling 23L is below the lower edges of the left and right side walls 23S and the lower surface of the terminal holding portion 22. That is, the coupling 23L projects down by a thickness of the coupling 23L from the lower surfaces of the side walls 23S. Further, a guiding surface 26 inclined down toward the front is formed on a front end of the upper surface of the coupling 23L.

The male terminal fitting 30 is formed into a predetermined shape by bending an elongated metal material. The male terminal fitting 30 includes a tab-like connecting portion 31 extending straight in the front-rear direction and a leg 32 extending down substantially at a right angle from the rear end of the tab-like connecting portion 31. A lower part of the leg 32 serves as a board connecting portion 33. The male terminal fitting 30 is mounted into the connector housing 21 by passing the tab-like connecting portion 31 through the press-fit hole 24 from behind the terminal holding portion 22.

A front area of the tab-like connecting portion 31 is accommodated in the receptacle 23. The front end of the tab-like connecting portion 31 is farther rearward than the rear end of the coupling 23L. The leg 32 is entirely behind the terminal holding portion 22 and is exposed to the outside of the connector housing 21. The board connecting portion 33 of the leg 32 is passed through the through hole 12 and connected to the conductor pattern of the circuit board 10 by soldering.

The board connector 20 is mounted on the circuit board 10 with the connector housing 21 placed on the upper surface 10S of the circuit board 10. More particularly, the connector housing 21 (terminal holding portion 22 and receptacle 23) is fixed to the upper surface 10S of the circuit board 10 by bringing the lower surface of the terminal holding portion 22 and the lower end surfaces of the both left and right side walls 23S into surface contact with the upper surface 10S of the circuit board 10 and screwing screws (not shown) passed through the mounting portions 25 into the circuit board 10.

Further, the front part of the receptacle 23 projects farther forward than the front edge 10F of the circuit board 10. This projecting amount of the receptacle 23 is equal to or slightly larger than a dimension of the coupling 23L in the front-rear direction. In this way, the rear surface of the coupling 23L is located to contact or face the front edge 10F (front end surface) of the circuit board 10 with a tiny clearance defined therebetween.

The female connector 40 includes a block-like terminal accommodating member 41 made of synthetic resin, and female terminal fittings 42 are accommodated in the terminal accommodating member 41. The female terminal fittings 42 are connected individually to end parts of wires 44 of the wiring harness 43, and the wires 44 are drawn out to a back surface (front side in the board connector 20) from the terminal accommodating member 41.

The female connector 40 is connected to the board connector 20 by being fit into the receptacle 23 from the front of cavities. When the connection is started, an outer peripheral part of the front surface of the female connector 40 contacts the guide surface 26 of the receptacle 23 even if the female connector 40 deviates up, down, left or right with respect to the receptacle 23 (board connector 20). In this way, a positional deviation of the female connector 40 is corrected by the inclination of the guiding surface 26 as the female connector 40 is fit. Thus, an operation of fitting the female connector 40 into the receptacle 23 is not hindered.

When the female connector 40 starts being fit into the receptacle 23, the lower surface of the female connector 40 slides in contact with the upper surface of the coupling 23L. At this time, the upper surface of the coupling portion 23L is substantially at the same height as or slightly higher than the upper surface 10S of the circuit board 10. Thus, a lower end part of the front surface of the female connector 40 does not interfere with the front edge 10F of the circuit board 10. When the female connector 40 reaches a proper connection position in the receptacle 23, the connection of the board connector 20 and the female connector 40 is completed, the female terminal fittings 42 are fit externally to the front end parts of the tab-like connecting portions 31 and the female terminal fittings 42 and the male terminal fittings 30 are connected conductively.

As described above, the connection structure of the first embodiment includes the circuit board 10, the connector housing 21 mounted on the circuit board 10 and the male terminal fittings 30 mounted in the connector housing 21. The connector housing 21 includes the terminal holding portion 22 fixed to the upper surface 10S of the circuit board 10 and the receptacle 23 extending forward only from the upper part 22U and the left and right sides 22S of the outer periphery of the terminal holding portion 22. The male terminal fitting 30 is held through the terminal holding portion 22 and includes the board connecting portion 33 connected to the circuit board 10 behind the terminal holding portion 22 and the tab-like connecting portion 31 accommodated into the receptacle 23 and to be connected to the female terminal fitting 42.

In the connection structure and the board connector 20 of the first embodiment, the area of the receptacle 23 facing the upper surface 10S of the circuit board 10 is open as the bottom surface opening 27. The bottom surface opening 27 is opposed to the upper surface 10S of the circuit board 10 and directly faces the internal space of the receptacle 23. That is, the receptacle 23 does not include a lower wall to be overlapped on the upper surface 10S of the circuit board 10. Thus, a height of the board connector 20 can be reduced by a thickness of the lower wall.

Heights of the tab-like connecting portions 31 from the upper surface 10S of the circuit board 10 become lower due to a height reduction of the board connector 20. In this way, electrical path lengths (height differences) between the female terminal fittings 42 of the female connector 40 fit into the receptacle 23 and the conductor pattern of the circuit board 10 become shorter so that transmission performance is excellent.

The receptacle 23 is formed with the coupling 23L that links the lowers of the left and right side walls 23S in front of the terminal holding portion 22. The coupling of the left and right side walls 23S by the coupling 23L enhances the strength of the receptacle 23 and prevents improper deformation of the left and right side walls 23S in the lateral direction. Moreover, the coupling 23L is disposed at the front part of the receptacle 23. Thus, a lower part of the female connector 40 immediately contacts the coupling 23L when the female connector 40 starts being fit into the receptacle 23. In this way, the female connector 40 can be positioned vertically with respect to the board connector 20 at the same time the female connector 40 starts being fit into the receptacle 23.

If the coupling portion 23L is disposed behind the front edge 10F of the circuit board 10, the circuit board 10 has to be formed with a cutout for avoiding interference with the coupling 23L. However, the coupling 23L is arranged in the area in front of the front edge 10F of the circuit board 10 in the first embodiment. Thus, the circuit board 10 need not be formed with a cutout for avoiding interference with the coupling portion 23L.

Further, the coupling 23L is disposed to contact or proximately face the front edge 10F of the circuit board 10. According to this configuration, if the coupling 23L is brought into contact with the front edge 10F of the circuit board 10 in mounting the board connector 20 on the circuit board 10, the connector housing 21 can be positioned in the front-rear direction with respect to the circuit board 10.

Second Embodiment

Aa second embodiment of the invention is described with reference to FIGS. 8 to 11. A board connector 50 and a connection structure for a circuit board 10 and the board connector 50 of the second embodiment are different from those in the first embodiment in the configuration of a receptacle 53 of a connector housing 51 of the board connector 50. Since the other components are the same as those of the first embodiment, the same components are denoted by the same reference signs and the structures, functions and effects thereof are not described.

The board connector 50 of the second embodiment is configured by mounting male terminal fittings 30 into the connector housing 51. The male terminal fittings 30 are the same components as those of the first embodiment and are not described again. The connector housing 51 is a single component including a wall-like terminal holding portion 22 and a receptacle 53 cantilevered forward from the terminal holding portion 22.

The receptacle 53 includes an upper wall 53U horizontally extending forward from an upper part 22U of the substantially rectangular outer periphery of the terminal holding portion 22 and left and right side walls 53S in the form of flat plates extending forward from both left and right sides 22S of the outer periphery of the terminal holding portion 22. The receptacle 53 is cantilevered forward only from the upper part 22U and the left and right side parts 22S of the outer periphery of the terminal holding portion 22, and not directly connected to a lower part of the outer periphery of the terminal holding portion 22.

The receptacle 53 of the second embodiment is not formed with a part equivalent to the coupling 23L of the first embodiment. Accordingly, the entire lower surface of the receptacle 53 serves as a bottom opening 54 allowing an internal space of the receptacle 53 to communicate with a lower space outside the board connector 50. The bottom surface opening 54 communicates with an opening on the front end of the receptacle 53.

The invention is not limited to the above described and illustrated embodiments. For example, the following embodiments also are included in the scope of the invention.

Although the coupling is disposed in the front end part of the receptacle in the first embodiment, the coupling portion be disposed in an area behind the front end of the receptacle.

Although the coupling is disposed forward of the front edge of the circuit board in the first embodiment, the coupling may be accommodated in a cutout formed in the circuit board.

Although the coupling is disposed to contact or proximately face the front edge of the circuit board in the first embodiment, the coupling may be at a position separated from the front edge of the circuit board.

Although the coupling is formed with the tapered guiding surface in the first embodiment, the coupling portion may not be formed with the guiding surface.

In the first and second embodiments, ribs and grooves for vertically positioning the female connector with respect to the receptacle may be formed on both left and right side walls of the receptacle and the left and right outer side surfaces of the female connector.

LIST OF REFERENCE SIGNS

10 . . . circuit board
10F . . . front end edge of circuit board
10S . . . upper surface of circuit board

20, 50 . . . board connector
21, 51 . . . connector housing
22 . . . terminal holding portion
22U . . . upper part of terminal holding portion
22S . . . side part of terminal holding portion
23, 53 . . . receptacle
23L . . . coupling
23S, 53S . . . side wall
30 . . . male terminal fitting
31 . . . tab-like connecting portion
33 . . . board connecting portion

The invention claimed is:

1. A board connector, comprising:

a connector housing including a terminal holding portion to be fixed to an upper surface of a circuit board and a receptacle having an upper wall facing the upper surface of the circuit board in a housing mounting direction and left and right side walls extending from opposite side edges of the upper wall along the housing mounting direction so that ends of the left and right side walls are in surface-to-surface contact with the upper surface of the circuit board, the receptacle being open in the housing mounting direction and in a front direction normal to the housing mounting direction;

male terminal fittings held through the terminal holding portion, each male terminal fitting including a board connecting portion to be connected to the circuit board behind the terminal holding portion and a tab-like connecting portion accommodated in the receptacle; and a mating connector having a front portion configured to fit into the receptacle of the connector housing from the front, the mating connector having female terminal fittings connected to the tab-like connecting portions of the male terminals when the front portion of the mating connector is fit into the receptacle of the connector housing, and a lower surface of the front portion of the mating connector that is fit into the receptacle of the connector housing being in surface-to-surface contact with the upper surface of the circuit board.

2. The board connector of claim 1, further comprising a coupling linking lower parts of left and right side walls constituting the receptacle in areas in front of the terminal holding portion.

3. The board connector of claim 2, wherein the coupling is disposed in a front end part of the receptacle.

4. A connection structure for circuit board and board connector, comprising:

a circuit board having an upper surface;

a connector housing including a terminal holding portion fixed to the upper surface of the circuit board and a receptacle having an upper wall facing the circuit board in a housing mounting direction, left and right side walls extending from opposite side edges of the upper wall along the housing mounting direction so that ends of the left and right side walls are in surface-to-surface contact with the upper surface of the circuit board, the receptacle being open in the housing mounting direction and in a front direction normal to the housing mounting direction;

male terminal fittings held through the terminal holding portion, each of the male terminal fittings including a board connecting portion connected to the circuit board behind the terminal holding portion and a tab-like connecting portion accommodated in the receptacle; and a mating connector having a front portion configured to fit into the receptacle of the connector housing from the front, the mating connector having female terminal fittings connected to the tab-like connecting portions of the male terminals when the front portion of the mating connector is fit into the receptacle of the connector housing, and a lower surface of the front portion of the mating connector that is fit into the receptacle of the connector housing being in surface-to-surface contact with the upper surface of the circuit board.

5. The connection structure for circuit board and board connector of claim 4, comprising a coupling linking lower parts of left and right side walls constituting the receptacle in areas in front of the terminal holding portion.

6. The connection structure for circuit board and board connector of claim 5, wherein the coupling is disposed in an area in front of a front edge of the circuit board.

7. The connection structure for circuit board and board connector of claim 6, wherein the coupling is disposed to contact or proximately face the front edge of the circuit board.

8. A connection structure for circuit board and board connector, comprising:

a circuit board having an upper surface;

a connector housing including a terminal holding portion fixed to the upper surface of the circuit board and a receptacle having an upper wall facing the circuit board, left and right side walls extending from opposite side edges of the upper wall to the upper surface of the circuit board, a lower part of the receptacle being closed by the circuit board and a front end of the receptacle opposite the terminal holding portion being open;

male terminal fittings held through the terminal holding portion, each of the male terminal fittings including a board connecting portion connected to the circuit board behind the terminal holding portion and a tab-like connecting portion accommodated in the receptacle; and a mating connector fit into the receptacle from the front, the mating connector having female terminal fittings connected to the tab-like connecting portions of the male terminals, a lower surface of the mating connector being in surface-to-surface contact with the upper surface of the circuit board.

9. The connection structure for circuit board and board connector of claim 8, comprising a coupling linking lower parts of left and right side walls constituting the receptacle in areas in front of the terminal holding portion.

10. The connection structure for circuit board and board connector of claim 9, wherein the coupling is disposed in an area in front of a front edge of the circuit board.

11. The connection structure for circuit board and board connector of claim 10, wherein the coupling is disposed to contact or proximately face the front edge of the circuit board.

* * * * *